US008876635B1

(12) United States Patent
Ogg

(10) Patent No.: US 8,876,635 B1
(45) **Date of Patent: *Nov. 4, 2014**

(54) GOLF BALL WITH DUAL CORE AND THERMOPLASTIC POLYURETHANE COVER

(75) Inventor: Steven S. Ogg, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 490 days.

This patent is subject to a terminal disclaimer.

(21) Appl. No.: 13/269,208

(22) Filed: Oct. 7, 2011

Related U.S. Application Data

(60) Provisional application No. 61/391,783, filed on Oct. 11, 2010.

(51) Int. Cl.
*A63B 37/06* (2006.01)

(52) U.S. Cl.
USPC ..... 473/376

(58) Field of Classification Search
USPC ..... 473/376
See application file for complete search history.

(56) References Cited

U.S. PATENT DOCUMENTS

| | | | | |
|---|---|---|---|---|
| 4,911,451 | A | 3/1990 | Sullivan et al. | |
| 4,986,545 | A | 1/1991 | Sullivan et al. | |
| 5,252,652 | A | 10/1993 | Egashira et al. | |
| 5,588,924 | A | 12/1996 | Sullivan et al. | |
| 5,721,304 | A | 2/1998 | Pasqua, Jr. | |
| 6,142,886 | A | 11/2000 | Sullivan et al. | |
| 6,210,293 | B1 | 4/2001 | Sullivan | |
| 6,495,633 | B1 | 12/2002 | Sullivan et al. | |
| 6,520,870 | B2 | 2/2003 | Tzivanis et al. | |
| 6,645,091 | B2 | 11/2003 | Wu et al. | |
| 6,872,782 | B2 | 3/2005 | Sullivan et al. | |
| 7,118,496 | B2 | 10/2006 | Matroni et al. | |
| 7,217,200 | B2 | 5/2007 | Matroni et al. | |
| 7,255,656 | B2 | 8/2007 | Sullivan et al. | |
| 7,338,392 | B2 | 3/2008 | Simonds et al. | |
| 7,367,903 | B2 | 5/2008 | Matroni et al. | |
| 7,419,443 | B2 | 9/2008 | Simonds et al. | |
| 7,468,007 | B2 | 12/2008 | Simonds et al. | |
| 7,625,302 | B2 * | 12/2009 | Watanabe et al. | 473/376 |
| 8,475,298 | B2 * | 7/2013 | Ogg et al. | 473/376 |

* cited by examiner

*Primary Examiner* — Raeann Gorden
(74) *Attorney, Agent, or Firm* — Michael A. Catania; Sonia Lari; Rebecca Hanovice

(57) ABSTRACT

A golf ball comprising a core comprising an inner core center and an outer core layer disposed over the inner core center. The inner core center has a deflection of greater than 0.210 inch under a load of 100 kilograms and the core has a deflection ranging from 0.120 inch to 0.090 inch under a load of 200 pounds. An inner mantle layer is disposed over the core, an outer mantle is disposed over the inner mantle layer, and a cover is disposed over the outer mantle.

3 Claims, 3 Drawing Sheets

GOLF BALL WITH DUAL CORE AND THERMOPLASTIC POLYURETHANE COVER

CROSS REFERENCES TO RELATED APPLICATIONS

The Present Application claims priority to U.S. Provisional Patent Application No. 61/391,783, filed on Oct. 11, 2010, which is hereby incorporated by reference in its entirety.

STATEMENT REGARDING FEDERALLY SPONSORED RESEARCH OR DEVELOPMENT

Not Applicable

BACKGROUND OF THE INVENTION

1. Field of the Invention

The present invention relates to golf balls. Particularly to golf balls having five layers including a dual core and a thermoplastic polyurethane cover.

2. Description of the Related Art

Sullivan et al., U.S. Pat. No. 4,911,451, for a GolfBall Cover Of Neutralized Poly(ethylene-acrylic acid) Copolymer, discloses in Table One a golf ball having a compression of below 50 and a cover composed of ionomers having various Shore D hardness values ranging from 50 to 61.

Sullivan, U.S. Pat. No. 4,986,545, for a Golf Ball discloses a golf ball having a Rhiele compression below 50 and a cover having Shore C values as low as 82.

Egashira et al., U.S. Pat. No. 5,252,652, for a Solid Golf Ball, discloses the use of a zinc pentachlorothiophenol in a core of a golf ball.

Pasqua, U.S. Pat. No. 5,721,304, for a Golf Ball Composition, discloses a golf ball with a core having a low compression and the core comprising calcium oxide.

Sullivan, et al., U.S. Pat. No. 5,588,924, for a Golf Ball discloses a golf ball having a PGA compression below 70 and a COR ranging from 0.780 to 0.825.

Sullivan et al., U.S. Pat. No. 6,142,886, for a Golf Ball And Method Of Manufacture discloses a golf ball having a PGA compression below 70, a cover Shore D hardness of 57, and a COR as high as 0.794.

Tzivanis et al., U.S. Pat. No. 652,870, for a Golf Ball, discloses a golf ball having a core compression less than 50, a cover Shore D hardness of 55 or less, and a COR greater than 0.80.

The prior art fails to disclose a five layer golf ball with a dual core that produces a high spin for short game shots and low spin for driver shots.

BRIEF SUMMARY OF THE INVENTION

One aspect of the present invention is a golf ball comprising a core comprising an inner core center and an outer core layer disposed over the inner core center. The inner core center comprises a polybutadiene material and has a deflection of greater than 0.210 inch under a load of 100 kilograms. The core has a deflection ranging from 0.130 inch to 0.105 inch under a load of 100 kilograms. An inner mantle layer is disposed over the core, an outer mantle layer is disposed over the inner mantle layer, and a cover is disposed over the outer mantle. The golf ball has a diameter ranging form 1.65 inches to 1.685 inches.

Another aspect of the present invention is a golf ball comprising a core comprising an inner core center and an outer core layer disposed over the inner core center. The inner core center comprises a polybutadiene material and has a deflection of greater than 0.210 inch under a load of 100 kilograms, wherein the core has a deflection ranging from 0.120 inch to 0.090 inch under a load of approximately 200 pounds. The core has a diameter ranging from 1.40 inches to 1.64 inches. An inner mantle layer is disposed over the core, an outer mantle layer is disposed over the inner mantle layer, and a cover is disposed over the outer mantle.

Yet another aspect of the present invention is a golf ball comprising a core comprising an inner core center and an outer core layer disposed over the inner core center. The inner core center comprises a polybutadiene material and has a deflection of greater than 0.210 inch under a load of 100 kilograms. The core has a deflection ranging from 0.120 inch to 0.095 inch under a load of 100 kilograms. The core has a diameter ranging from 1.40 inches to 1.64 inches. An inner mantle layer is disposed over the core, an outer mantle layer is disposed over the inner mantle layer, and a cover is disposed over the outer mantle.

A golf ball comprising a core, an inner mantle layer, an outer mantle layer and a cover. The core comprises an inner core and an outer core disposed over the inner core. The inner core has a deflection of at least 0.230 inch under a load of 220 pounds, and the outer core has a deflection of at least 0.800 inch under a load of 200 pounds. The inner mantle layer is disposed over the outer core. The inner mantle layer has a thickness ranging from 0.070 inch to 0.090 inch. The inner mantle layer is composed of an ionomer material. The inner mantle layer material has a plaque Shore D hardness ranging from 36 to 44. The outer mantle layer is disposed over the inner mantle layer. The outer mantle layer has a thickness ranging from 0.025 inch to 0.040 inch. The outer mantle layer is composed of an ionomer material. The outer mantle layer material has a plaque Shore D hardness ranging from 65 to 71. The cover layer is disposed over the outer mantle layer. The cover has a thickness ranging from 0.025 inch to 0.040 inch. The cover is composed of a thermoplastic polyurethane material. The cover material has a plaque Shore D hardness ranging from 40 to 50, and an on cover Shore D hardness less than 56.

A golf ball comprising a core, an inner mantle layer, an outer mantle layer and a cover. The core comprises an inner core and an outer core disposed over the inner core. The inner core has a deflection of at least 0.210 inch under a load of 220 pounds, and the combined outer core and the inner core have a deflection no more than 0.120 inch under a load of 200 pounds. The inner mantle layer is disposed over the outer core. The inner mantle layer has a thickness ranging from 0.030 inch to 0.090 inch. The inner mantle layer material has a plaque Shore D hardness ranging from 30 to 50. The outer mantle layer is disposed over the inner mantle layer. The outer mantle layer has a thickness ranging from 0.025 inch to 0.070 inch. The outer mantle layer material has a plaque Shore D hardness ranging from 50 to 71. The inner mantle is thicker than the outer mantle and the outer mantle is harder than the inner mantle. The cover layer is disposed over the outer mantle layer. The cover has a thickness ranging from 0.025 inch to 0.050 inch. The cover has a Shore D hardness less than the hardness of the outer mantle layer.

A golf ball a core, an inner mantle layer, an outer mantle layer and a cover. The core comprises an inner core and an outer core disposed over the inner core. The inner core has a deflection of at least 0.210 inch under a load of 220 pounds, and the combined outer core and inner core have a deflection of no greater than 0.110 inch under a load of 200 pounds. The inner mantle layer is disposed over the outer core. The inner mantle layer has a thickness ranging from 0.025 inch to 0.090 inch. The inner mantle layer is composed of an ionomer material. The inner mantle layer material has a plaque Shore D hardness ranging from 30 to 50. The outer mantle layer is disposed over the inner mantle layer. The outer mantle layer has a thickness ranging from 0.025 inch to 0.050 inch. The outer mantle layer is composed of an ionomer material. The outer mantle layer material has a plaque Shore D hardness ranging from 62 to 72. The cover layer is disposed over the outer mantle layer. The cover has a thickness ranging from 0.025 inch to 0.045 inch. The outer mantle has a larger Shore D value than the cover.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The present invention is directed to a golf ball comprising a dual-core component and a multi-layer cover. The present invention includes a variety of different embodiments as follows.

The novel multi-layer golf ball covers of the present invention include at least one polyurethane material. The multi-layer cover comprises a thermoplastic polyurethane. Preferably, the outer mantle layer and the inner mantle layer are preferably composed of ionomer materials. Alternatively, at least one of the outer mantle layer and the inner mantle layer its composed of a block copolymer material such as PEBAX.

The present invention golf balls utilize a unique dual-core configuration. Preferably, the cores comprise (i) an interior spherical center component formed from a thermoset material, a thermoplastic material, or combinations thereof; and (ii) a core layer disposed about the spherical center component, the core layer formed from a thermoset material, a thermoplastic material, or combinations thereof. The cores may further comprise (iii) an optional outer core layer disposed about the core layer. The outer core layer may be formed from a thermoset material, a thermoplastic material, or combinations thereof.

Although the present invention is primarily directed to golf balls comprising a dual core component and a multi-layer cover as described herein, the present invention also includes golf balls having a dual core component and conventional covers comprising balata, various thermoplastic materials, cast polyurethanes, or any other known cover materials. Furthermore, the present invention also encompasses golf balls having a dual core component and a single layer polyurethane cover.

It has been found that multi-layer golf balls having inner and outer cover layers exhibit higher C.O.R. values and have greater travel distance in comparison with balls made from a single cover layer.

Accordingly, the present invention is directed to a golf ball comprising a dual-core configuration and an improved multi-layer cover which produces, upon molding each layer around a core to formulate a multi-layer cover, a golf ball exhibiting enhanced distance (i.e., resilience) without adversely affecting, and in many instances, improving the ball's playability (hardness/softness) and/or durability (i.e., cut resistance, fatigue resistance, etc.) characteristics.

Figure 1:
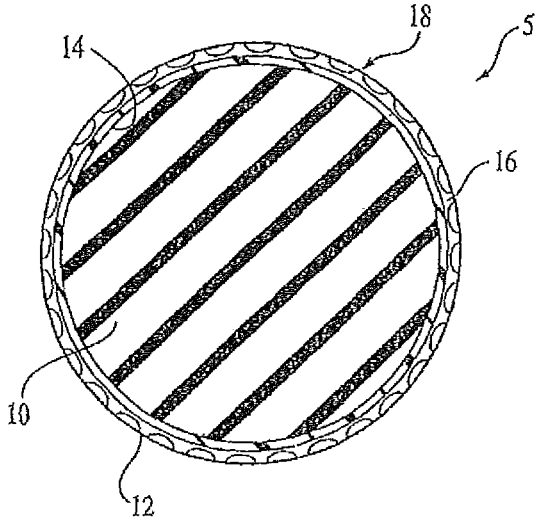
FIG. 1 is a cross-sectional view of a golf ball.
Figure 2:
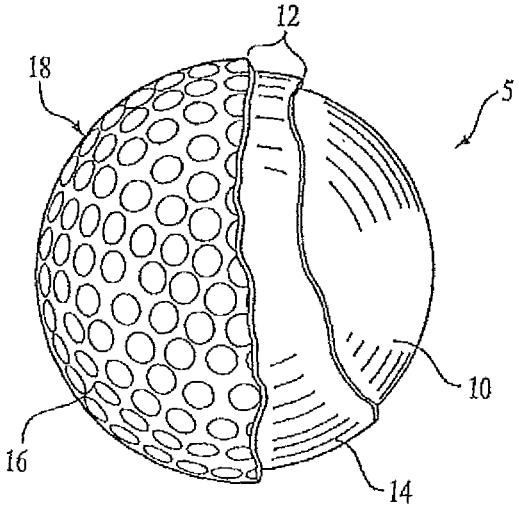
FIG. 2 is a diametrical cross-sectional view of the preferred embodiment of a the golf ball depicted in FIG. 1 having a core and a cover comprising an inner layer surrounding the core and an outer layer having a plurality of dimples.

FIGS. 1 and 2 illustrate a preferred embodiment golf ball 5 in accordance with the present invention. It will be understood that none of the referenced figures are to scale. And so, the thicknesses and proportions of the various layers and the diameter of the various core components are not necessarily as depicted. The golf ball 5 comprises a multi-layered cover 12 disposed about a core 10. The core 10 of the golf ball can be formed of a solid, a liquid, or any other substances that may be utilized to form the novel dual core described herein. The multi-layered cover 12 comprises two layers: a first or inner layer or ply 14 and a second or outer layer or ply 16. The inner layer 14 can be comprised of ionomer, ionomer blends, non-ionomer, non-ionomer blends, or blends of ionomer and non-ionomer. The outer layer 16 is preferably harder than the inner layer and can be comprised of ionomer, ionomer blends, non-ionomer, non-ionomer blends or blends of ionomer and non-ionomer. Although the outer cover layer is preferably harder than the inner cover layer, the present invention includes cover configurations in which the outer layer is softer than the inner layer.

In a first preferred embodiment, the inner layer 14 is comprised of a high acid (i.e. greater than 16 weight percent acid) ionomer resin or high acid ionomer blend. Preferably, the inner layer is comprised of a blend of two or more high acid (i.e., at least 16 weight percent acid) ionomer resins neutralized to various extents by different metal cations. The inner cover layer may or may not include a metal stearate (e.g., zinc stearate) or other metal fatty acid salt. The purpose of the metal stearate or other metal fatty acid salt is to lower the cost of production without affecting the overall performance of the finished golf ball. In a second embodiment, the inner layer 14 is comprised of a low acid (i.e., 16 weight percent acid or less) ionomer blend. Preferably, the inner layer is comprised of a blend of two or more low acid (i.e., 16 weight percent acid or less) ionomer resins neutralized to various extents by different metal cations. The inner cover layer may or may not include a metal stearate (e.g., zinc stearate) or other metal fatty acid salt.

Two principal properties involved in golf ball performance are resilience and hardness. Resilience is determined by the coefficient of restitution (C.O.R.), the constant "e" which is the ratio of the relative velocity of two elastic spheres after direct impact to that before impact. As a result, the coefficient of restitution ("e") can vary from 0 to 1, with 1 being equivalent to an elastic collision and 0 being equivalent to an inelastic collision.

Resilience (C.O.R.), along with additional factors such as club head speed, angle of trajectory and ball configuration (i.e., dimple pattern) generally determine the distance a ball will travel when hit. Since club head speed and the angle of trajectory are factors not easily controllable by a manufacturer, factors of concern among manufacturers are the coefficient of restitution (C.O.R.) and the surface configuration of the ball.

The coefficient of restitution (C.O.R.) in solid core balls is a function of the composition of the molded core and of the cover. In balls containing a dual core (i.e., balls comprising an interior spherical center component, a core layer disposed about the spherical center component, and a cover), the coefficient of restitution is a function of not only the composition of the cover, but also the composition and physical characteristics of the interior spherical center component and core layer. Both the dual core and the cover contribute to the coefficient of restitution in the golf balls of the present invention.

In this regard, the coefficient of restitution of a golf ball is generally measured by propelling a ball at a given speed against a hard surface and measuring the ball's incoming and outgoing velocities electronically. As mentioned above, the coefficient of restitution is the ratio of the outgoing velocity to the incoming velocity. The coefficient of restitution must be carefully controlled in all commercial golf balls in order for the ball to be within the specifications regulated by the United States Golf Association (U.S.G.A.) Along this line, the U.S.G.A. standards indicate that a "regulation" ball cannot have an initial velocity (i.e., the speed off the club) exceeding 255 feet per second. Since the coefficient of restitution of a ball is related to the ball's initial velocity, it is highly desirable to produce a ball having sufficiently high coefficient of restitution to closely approach the U.S.G.A. limit on initial velocity, while having an ample degree of softness (i.e., hardness) to produce enhanced playability (i.e., spin, etc.).

Dual Core

As noted, the present invention golf balls utilize a unique dual core configuration. Preferably, the cores comprise (i) an interior spherical center component formed from a thermoset material, a thermoplastic material, or combinations thereof and (ii) a core layer disposed about the spherical center component, the core layer formed from a thermoset material, a thermoplastic material, or combinations thereof. Most preferably, the core layer is disposed immediately adjacent to, and in intimate contact with the center component. The cores may further comprise (iii) an optional outer core layer disposed about the core layer. Most preferably, the outer core layer is disposed immediately adjacent to, and in intimate contact with the core layer. The outer core layer may be formed from a thermoset material, a thermoplastic material, or combinations thereof.

Figure 3:
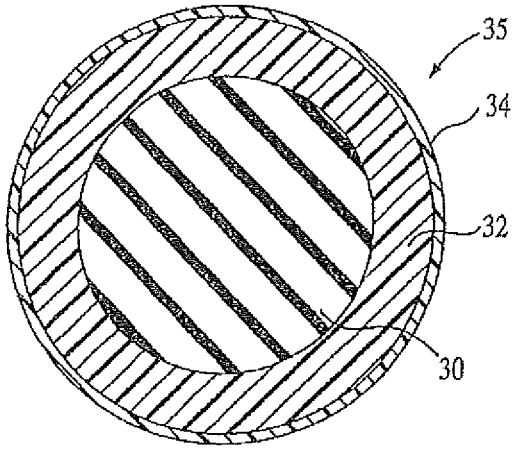
FIG. 3 is a cross-sectional view of a golf ball.

The present invention provides several additionally preferred embodiment golf balls utilizing the unique dual core configuration and the previously described cover layers. Referring to FIG. 3, a preferred embodiment golf ball 35 is illustrated comprising a core 30 formed from a thermoset material surrounded by a core layer 32 formed from a thermoplastic material. A multi-layer cover 34 surrounds the core 30 and core layer 32. The multi-layer cover 34 preferably corresponds to the previously described multi-layer cover 12.

Figure 4:
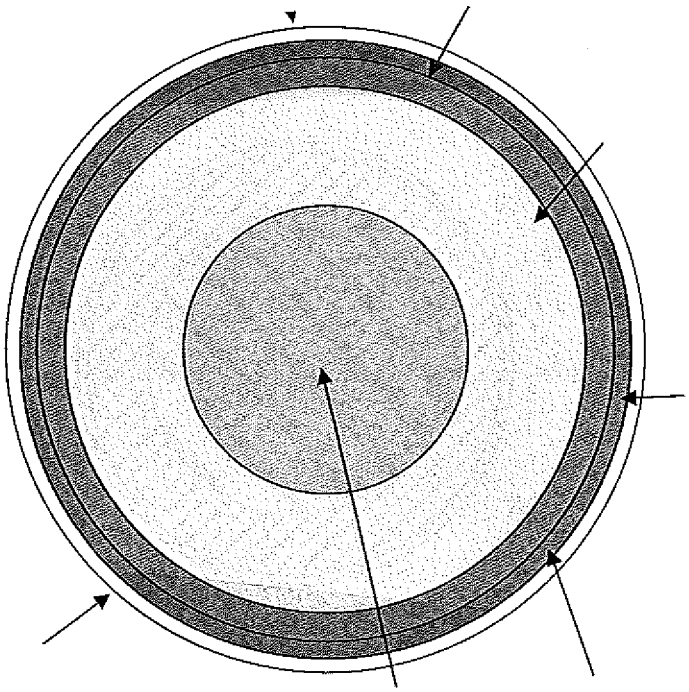
FIG. 4 is a cross-sectional view of a preferred embodiment of a golf ball comprising a dual core component, an inner mantle layer, an outer mantle layer and a cover.

As illustrated in FIG. 4, another preferred embodiment golf ball 45 in accordance with the present invention is illustrated. The preferred embodiment golf ball 45 comprises a core 40 formed from a thermoplastic material surrounded by a core layer 42. The core layer 42 is formed from a thermoset material. A multi-layer cover 44 surrounds the core 40 and the core layer 42. Again, the multi-layer cover 44 preferably corresponds to the previously described multi-layer cover 12.

Figure 5:
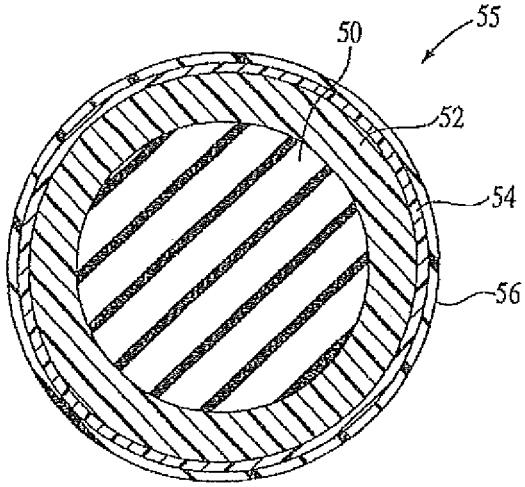
FIG. 5 is a cross-sectional view of a golf ball of the present invention.

FIG. 5 illustrates yet another preferred embodiment golf ball 55 in accordance with the present invention. The preferred embodiment golf ball 55 comprises a core 50 formed from a thermoplastic material. A core layer 52 surrounds the core 50. The core layer 52 is formed from a thermoplastic material which may be the same as the material utilized with the core 50, or one or more other or different thermoplastic materials. The preferred embodiment golf ball 55 utilizes an optional outer core layer 54 that surrounds the core component 50 and the core layer 52. The outer core layer 54 is formed from a thermoplastic material which may be the same or different than any of the thermoplastic materials utilized by the core 50 and the core layer 52. The golf ball 55 further comprises a multi-layer cover 56 that is preferably similar to the previously described multi-layer cover 12.

Preferably the inner core has a diameter ranging from 0.75 inch to 1.20 inches, more preferably from 0.85 inch to 1.05 inch, and most preferably approximately 0.95 inch. Preferably the inner core has a Shore D hardness ranging from 20 to 50, more preferably from 25 to 40, and most preferably approximately 35. Preferably the inner core is formed from a polybutadiene, zinc diacrylate, zinc oxide, zinc stearate, a peptizer and peroxide. Preferably the inner core has a mass ranging from 5 grams to 15 grams, 7 grams to 10 grams and most preferably approximately 8 grams.

Preferably the outer core has a diameter ranging from 1.25 inch to 1.55 inches, more preferably from 1.40 inch to 1.5 inch, and most preferably approximately 1.5 inch. Preferably the inner core has a Shore D surface hardness ranging from 40 to 65, more preferably from 50 to 60, and most preferably approximately 56. Preferably the inner core is formed from a polybutadiene, zinc diacrylate, zinc oxide, zinc stearate, a peptizer and peroxide. Preferably the combined inner core and outer core have a mass ranging from 25 grams to 35 grams, 30 grams to 34 grams and most preferably approximately 32 grams.

Figure 6:
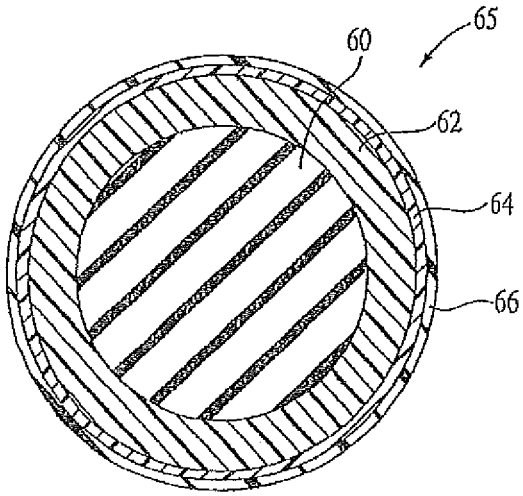
FIG. 6 is a cross-sectional view of a golf ball of the present invention comprising a dual core component and an outer core layer.

FIG. 6 illustrates yet another preferred embodiment golf ball 65 in accordance with the present invention. The preferred embodiment golf ball 65 comprises a core 60 formed from a thermoplastic, thermoset material, or any combination of a thermoset and thermoplastic material. A core layer 62 surrounds the core 60. The core layer 62 is formed from a thermoset material. The preferred embodiment golf ball 65 also comprises an optional outer core layer 64 formed from a thermoplastic material. A multi-layer cover 66, preferably similar to the previously described multi-layer cover 12, is disposed about, and generally surrounds, the core 60, the core layer 62 and the outer core 64.

A wide array of thermoset materials can be utilized in the present invention dual cores. Examples of suitable thermoset materials include butadiene or any natural or synthetic elastomer, including metallocene polyolefins, polyurethanes, silicones, polyamides, polyureas, or virtually any irreversibly cross-linked resin system. It is also contemplated that epoxy, phenolic, and an array of unsaturated polyester resins could be utilized.

The thermoplastic material utilized in the present invention golf balls and, particularly their dual cores, may be nearly any thermoplastic material. Examples of typical thermoplastic materials for incorporation in the golf balls of the present invention include, but are not limited to, ionomers, polyurethane thermoplastic elastomers, and combinations thereof. It is also contemplated that a wide array of other thermoplastic materials could be utilized, such as polysulfones, fluoropolymers, polyamide imides, polyarylates, polyaryletherketones, polyaryl sulfones/polyether sulfones, polybenzimidazoles, polyether-imides, polyimides, liquid crystal polymers, polyphenylene sulfides; and specialty high-performance resins, and ultrahigh molecular weight polyethylenes.

Additional examples of suitable thermoplastics include metallocenes, polyvinyl chlorides, acrylonitrile-butadiene-styrenes, acrylics, styrene-acrylonitriles, styrene-maleic anhydrides, polyamides (nylons), polycarbonates, polybutylene terephthalates, polyethylene terephthalates, polyphenylene ethers/polyphenylene oxides, reinforced polypropylenes, and high-impact polystyrenes.

Preferably, the thermoplastic materials have relatively high melting points, such as a melting point of at least about 300° F. Several examples of these preferred thermoplastic materials and which are commercially available include, but are not limited to, Capron® (a blend of nylon and ionomer), Lexan® polycarbonate, Pebax®, and Hytrel®. The polymers or resin system may be cross-linked by a variety of means such as by peroxide agents, sulphur agents, radiation or other cross-linking techniques.

Any or all of the previously described components in the cores of the golf ball of the present invention may be formed in such a manner, or have suitable fillers added, so that their resulting density is decreased or increased. For example, any of these components in the dual cores could be formed or otherwise produced to be light in weight. For instance, the components could be foamed, either separately or in-situ. Related to this, a foamed light weight filler agent may be added. In contrast, any of these components could be mixed with or otherwise receive various high density filler agents or other weighting components such as relatively high density fibers or particulate agents in order to increase their mass or weight.

The cores of the inventive golf balls typically have a coefficient of restitution of about 0.750 or more, more preferably 0.770 or more and a PGA compression of about 100 or less, and more preferably 80 or less. The cores have a weight of 25 to 40 grams and preferably 30 to 40 grams. The core can be compression molded from a slug of uncured or lightly cured elastomer composition comprising a high cis content polybutadiene and a metal salt of an alpha, beta-ethylenically unsaturated carboxylic acid such as zinc mono- or diactylate or methacrylate. To achieve higher coefficients of restitution and/or to increase hardness in the core, the manufacturer may include a small amount of a metal oxide such as zinc oxide. In addition, larger amounts of metal oxide than are needed to achieve the desired coefficient may be included in order to increase the core weight so that the finished ball more closely approaches the U.S.G.A. upper weight limit of 1.620 ounces. Non-limiting examples of other materials which may be used in the core composition include compatible rubbers or ionomers, and low molecular weight fatty acids such as stearic acid. Free radical initiator catalysts such as peroxides are admixed with the core composition so that on the application of heat and pressure, a curing or cross-linking reaction takes place.

Wound cores are generally produced by winding a very long elastic thread around a solid or liquid filled balloon center. The elastic thread is wound around the center to produce a finished core of about 1.4 to 1.6 inches in diameter, generally. However, the preferred embodiment golf balls of the present invention preferably utilize a solid core, or rather a solid dual core configuration, as opposed to a wound core.

Method of Making Golf Ball

In preparing golf balls in accordance with the present invention, a soft inner cover layer is molded (preferably by injection molding or by compression molding) about a core (preferably a solid core, and most preferably a dual core). A comparatively harder outer layer is molded over the inner layer.

The dual cores of the present invention are preferably formed by compression molding techniques. However, it is fully contemplated that liquid injection molding or transfer molding techniques could be utilized.

In a particularly preferred embodiment of the invention, the golf ball preferably has an aerodynamic pattern such as disclosed in Simonds et al., U.S. Pat. No. 7,419,443 for a Low Volume Cover For A Golf Ball, which is hereby incorporated by reference in its entirety. Alternatively, the golf ball has an aerodynamic pattern such as disclosed in Simonds et al., U.S. Pat. No. 7,338,392 for An Aerodynamic Surface Geometry For A Golf Ball, which is hereby incorporated by reference in its entirety. Alternatively, the golf ball has an aerodynamic pattern such as disclosed in Simonds et al., U.S. Pat. No. 7,468,007 for a Dual Dimple Surface Geometry For A Golf Ball, which is hereby incorporated by reference in its entirety.

The various cover composition layers of the present invention may be produced according to conventional melt blending procedures. Generally, the copolymer resins are blended in a Banbury® type mixer, two-roll mill, or extruder prior to neutralization. After blending, neutralization then occurs in the melt or molten states in the Banbury® mixer. Mixing problems are minimal because preferably more than 75 wt %, and more preferably at least 80 wt % of the ionic copolymers in the mixture contain acrylate esters and, in this respect, most of the polymer chains in the mixture are similar to each other. The blended composition is then formed into slabs, pellets, etc., and maintained in such a state until molding is desired. Alternatively, a simple dry blend of the pelletized or granulated resins, which have previously been neutralized to a desired extent, and colored masterbatch may be prepared and fed directly into the injection molding machine where homogenization occurs in the mixing section of the barrel prior to injection into the mold. If necessary, further additives such as an inorganic filler, etc., may be added and uniformly mixed before initiation of the molding process. A similar process is utilized to formulate the high acid ionomer resin compositions used to produce the inner cover layer. In one embodiment of the invention, a masterbatch of non-acrylate ester-containing ionomer with pigments and other additives incorporated therein is mixed with the acrylate ester-containing copolymers in a ratio of about 1-7 weight % masterbatch and 93-99 weight % acrylate ester-containing copolymer.

Preferably the cover is composed of a thermoplastic polyurethane/polyurea material. One example is disclosed in U.S. Pat. No. 7,367,903 for a Golf Ball, which is hereby incorporated by reference in its entirety.

The outer mantle layer is preferably composed of a blend of ionomers, preferably comprising at least two high acid (greater than 18 weight percent) ionomers neutralized with sodium, zinc, or other metal ions. The blend of ionomers also preferably includes a masterbatch. The outer mantle layer preferably has a Shore D hardness ranging preferably from 55 to 75, more preferably from 60 to 70, a most preferably approximately 66. The plaque Shore D hardness is preferably greater by at least two points. The thickness of the outer mantle layer preferably ranges from 0.025 inch to 0.050 inch, and is more preferably approximately 0.030 inch. The mass of the entire insert including the dual core, the inner mantle layer and the outer mantle layer preferably ranges from 38 grams to 43 grams, more preferably from 39 to 41 grams, and is most preferably approximately 40 grams.

The inner mantle layer is preferably composed of a blend of ionomers, preferably comprising a terpolymer and at least two high acid (greater than 18 weight percent) ionomers neutralized with sodium, zinc, magnesium, or other metal ions. The inner mantle layer preferably has a Shore D hardness ranging preferably from 35 to 77, more preferably from 40 to 60, a most preferably approximately 55. The plaque Shore D hardness is preferably greater by at least two points. The thickness of the outer mantle layer preferably ranges from 0.025 inch to 0.050 inch, and is more preferably approximately 0.037 inch. The mass of an insert including the dual core and the inner mantle layer preferably ranges from 32 grams to 40 grams, more preferably from 34 to 38 grams, and is most preferably approximately 36 grams The inner mantle layer is alternatively composed of a HPF material available from DuPont. Alternatively, the mantle layer is composed of a material such as disclosed in Kennedy, III et al., U.S. Pat. No. 7,361,101 for a Golf Ball And Thermoplastic Material, which is hereby incorporated by reference in its entirety The golf balls of the present invention can be produced by molding processes which include but are not limited to those which are currently well known in the golf ball art. For example, the golf balls can be produced by injection molding or compression molding the novel cover compositions around a wound or solid molded core to produce an inner ball which typically has a diameter of about 1.50 to 1.67 inches. The core, preferably of a dual core configuration, may be formed as previously described. The outer layer is subsequently molded over the inner layer to produce a golf ball having a diameter of 1.620 inches or more, preferably about 1.680 inches or more. Although either solid cores or wound cores can be used in the present invention, as a result of their lower cost and superior performance solid molded cores are preferred over wound cores. The standards for both the minimum diameter and maximum weight of the balls are established by the United States Golf Association (U.S.G.A.).

In compression molding, the inner cover composition is formed via injection at about 380° F. to about 450° F. into smooth surfaced hemispherical shells which are then positioned around the core in a mold having the desired inner cover thickness and subjected to compression molding at 200° to 300° F. for about 2 to 10 minutes, followed by cooling at 50° to 70° F. for about 2 to 7 minutes to fuse the shells together to form a unitary intermediate ball. In addition, the intermediate balls may be produced by injection molding wherein the inner cover layer is injected directly around the core placed at the center of an intermediate ball mold for a period of time in a mold temperature of from 50° to about 100° F. Subsequently, the outer cover layer is molded around the core and the inner layer by similar compression or injection molding techniques to form a dimpled golf ball of a diameter of 1.680 inches or more.

Various aspects of the present invention golf balls have been described in terms of certain tests or measuring procedures. These are described in greater detail as follows.

Shore D Hardness

As used herein, "Shore D hardness" of a cover is measured generally in accordance with ASTM D-2240 type D, except the measurements may be made on the curved surface of a molded cover, rather than on a plaque. Furthermore, the Shore D hardness of the cover is measured while the cover remains over the mantles and cores. When a hardness measurement is made on a dimpled cover, Shore D hardness is preferably measured at a land area of the dimpled cover.

Shore A Hardness

As used herein, "Shore A hardness" of a cover is measured generally in accordance with ASTM D-2240 type A, except the measurements may be made on the curved surface of a molded cover, rather than on a plaque. Furthermore, the Shore A hardness of the cover is measured while the cover remains over the mantles and cores. When a hardness measurement is made on a dimpled cover, Shore A hardness is preferably measured at a land area of the dimpled cover Coefficient of Restitution The resilience or coefficient of restitution (COR) of a golf ball is the constant "e," which is the ratio of the relative velocity of an elastic sphere after direct impact to that before impact. As a result, the COR ("e") can vary from 0 to 1, with 1 being equivalent to a perfectly or completely elastic collision and 0 being equivalent to a perfectly or completely inelastic collision.

COR, along with additional factors such as club head speed, club head mass, ball weight, ball size and density, spin rate, angle of trajectory and surface configuration (i.e., dimple pattern and area of dimple coverage) as well as environmental conditions (e.g. temperature, moisture, atmospheric pressure, wind, etc.) generally determine the distance a ball will travel when hit. Along this line, the distance a golf ball will travel under controlled environmental conditions is a function of the speed and mass of the club and size, density and resilience (COR) of the ball and other factors. The initial velocity of the club, the mass of the club and the angle of the ball's departure are essentially provided by the golfer upon striking. Since club head speed, club head mass, the angle of trajectory and environmental conditions are not determinants controllable by golf ball producers and the ball size and weight are set by the U.S.G.A., these are not factors of concern among golf ball manufacturers. The factors or determinants of interest with respect to improved distance are generally the coefficient of restitution (COR) and the surface configuration (dimple pattern, ratio of land area to dimple area, etc.) of the ball.

The COR in solid core balls is a function of the composition of the molded core and of the cover. The molded core and/or cover may be comprised of one or more layers such as in multi-layered balls. In balls containing a wound core (i.e., balls comprising a liquid or solid center, elastic windings, and a cover), the coefficient of restitution is a function of not only the composition of the center and cover, but also the composition and tension of the elastomeric windings. As in the solid core balls, the center and cover of a wound core ball may also consist of one or more layers.

The coefficient of restitution is the ratio of the outgoing velocity to the incoming velocity. In the examples of this application, the coefficient of restitution of a golf ball was measured by propelling a ball horizontally at a speed of 125+/−5 feet per second (fps) and corrected to 125 fps against a generally vertical, hard, flat steel plate and measuring the ball's incoming and outgoing velocity electronically. Speeds were measured with a pair of Oehler Mark 55 ballistic screens available from Oehler Research, Inc., P.O. Box 9135, Austin, Tex. 78766, which provide a timing pulse when an object passes through them. The screens were separated by 36 inches and are located 25.25 inches and 61.25 inches from the rebound wall. The ball speed was measured by timing the pulses from screen 1 to screen 2 on the way into the rebound wall (as the average speed of the ball over 36 inches), and then the exit speed was timed from screen 2 to screen 1 over the same distance. The rebound wall was tilted 2 degrees from a vertical plane to allow the ball to rebound slightly downward in order to miss the edge of the cannon that fired it. The rebound wall is solid steel.

As indicated above, the incoming speed should be 125±5 fps but corrected to 125 fps. The correlation between COR and forward or incoming speed has been studied and a correction has been made over the ±5 fps range so that the COR is reported as if the ball had an incoming speed of exactly 125.0 fps.

The coefficient of restitution must be carefully controlled in all commercial golf balls if the ball is to be within the specifications regulated by the United States Golf Association (U.S.G.A.). As mentioned to some degree above, the U.S.G.A. standards indicate that a "regulation" ball cannot have an initial velocity exceeding 255 feet per second in an atmosphere of 75° F. when tested on a U.S.G.A. machine. Since the coefficient of restitution of a ball is related to the ball's initial velocity, it is highly desirable to produce a ball having sufficiently high coefficient of restitution to closely approach the U.S.G.A. limit on initial velocity, while having an ample degree of softness (i.e., hardness) to produce enhanced playability (i.e., spin, etc.).

The hardness of the ball is the second principal property involved in the performance of a golf ball. The hardness of the ball can affect the playability of the ball on striking and the sound or "click" produced. Hardness is determined by the deformation (i.e., compression) of the ball under various load conditions applied across the ball's diameter (i.e., the lower the compression value, the harder the material).

In one embodiment of the present invention of a golf ball, the golf ball comprises an inner core center and an outer core layer disposed over the inner core center. The inner core center comprises a polybutadiene material and has a deflection of greater than 0.210 inch under a load of 100 kilograms, wherein the core (combination of the inner core and the outer core) has a deflection ranging from 0.130 inch to 0.090 inch under a load of 200 pounds. An inner mantle layer is disposed over the core, an outer mantle is disposed over the inner mantle, and a cover is disposed over the outer mantle. The golf ball preferably has a diameter ranging from 1.65 inches to 1.685 inches.

Preferably, the golf ball cover is composed of a thermoplastic polyurethane/polyurea material. The golf ball cover preferably has a thickness ranging from 0.015 inch to 0.045 inch. Each mantle layer is preferably composed of an ionomer material. Alternatively, each mantle layer is composed of a blend of ionomer materials. Alternatively, at least one of the mantle layers is composed of a highly neutralized ionomer material. The combined mantle layers preferably have a thickness ranging from 0.030 inch to 0.075 inch, and most preferably less than 0.067 inch. The core preferably has a diameter ranging from 1.40 inches to 1.64 inches. Preferably, the golf ball has a coefficient of restitution greater than 0.79.

In another embodiment of the present invention the golf ball comprises a core comprising an inner core center and an outer core layer disposed over the inner core center. The inner core center comprises a polybutadiene material and has a deflection of greater than 0.210 inch under a load of 100 kilograms. The core (combination of the inner core and the outer core) has a deflection ranging from 0.120 inch to 0.095 inch under a load of 100 kilograms. The core has a deflection ranging from 0.120 inch to 0.090 inch under a load of 100 kilograms. An inner mantle layer is disposed over the core, an outer mantle is disposed over the inner mantle, and a cover is disposed over the outer mantle. The cover is composed of a thermoplastic polyurethane and has a thickness ranging from 0.015 inch to 0.030 inch. The golf ball has a diameter ranging from 1.65 inches to 1.685 inches.

Preferably, each mantle layer is composed of an ionomer material. Alternatively, each mantle layer is composed of a blend of ionomer materials. Alternatively, at least one of the mantle layer is composed of a highly neutralized ionomer material. Preferably, each mantle layer has a thickness ranging from 0.030 inch to 0.090 inch.

In yet another embodiment, the golf ball of the present invention comprises a core comprising an inner core center and an outer core layer disposed over the inner core center. The inner core center comprises a polybutadiene material and has a deflection of greater than 0.220 inch under a load of 100 kilograms, wherein the core (combination of the inner core and the outer core) has a deflection ranging from 0.120 inch to 0.090 inch under a load of 200 pounds. The core has a diameter ranging from 1.40 inches to 1.64 inches. An inner mantle layer is disposed over the core, an outer mantle is disposed over the inner mantle, and a cover is disposed over the outer mantle.

The measurements for deflection, compression, hardness, and the like are preferably performed on a finished golf ball as opposed to performing the measurement on each layer during manufacturing.

Preferably, in a five layer golf ball comprising an inner core, an outer core, an inner mantle layer, an outer mantle layer and a cover, the hardness/compression of layers involve an inner core with the greatest deflection (lowest hardness), an outer core (combined with the inner core) with a deflection less than the inner core, an inner mantle layer with a hardness less than the hardness of the combined outer core and inner core, an outer mantle layer with the hardness layer of the golf ball, and a cover with a hardness less than the hardness of the outer mantle layer. These measurements are preferably made on a finished golf ball that has been torn down for the measurements.

Preferably the inner mantle layer is thicker than the outer mantle layer or the cover layer. The dual core and dual mantle golf ball creates an optimized velocity-initial velocity ratio (Vi/IV), and allows for spin manipulation. The dual core provides for increased core compression differential resulting in a high spin for short game shots and a low spin for driver shots. A discussion of the USGA initial velocity test is disclosed in Yagley et al., U.S. Pat. No. 6,595,872 for a Golf Ball With High Coefficient Of Restitution, which is hereby incorporated by reference in its entirety. Another example is Bartels et al., U.S. Pat. No. 6,648,775 for a Golf Ball With High Coefficient Of Restitution, which is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention the following:

1. A golf ball consisting of:

a core comprising an inner core and an outer core disposed over the inner core, the inner core having a deflection of at least 0.230 inch under a load of 220 pounds, and the core having a deflection of at least 0.800 inch under a load of 200 pounds;

an inner mantle layer disposed over the outer core, the inner mantle layer having a thickness ranging from 0.070 inch to 0.090 inch, the inner mantle layer composed of an ionomer material, the inner mantle layer material having a plaque Shore D hardness ranging from 36 to 44;

an outer mantle layer disposed over the inner mantle layer, the outer mantle layer having a thickness ranging from 0.025 inch to 0.040 inch, the outer mantle layer composed of an ionomer material, the outer mantle layer material having a plaque Shore D hardness ranging from 65 to 71; and a cover layer disposed over the outer mantle layer, the cover having a thickness ranging from 0.025 inch to 0.040 inch, the cover composed of a thermoplastic polyurethane material, the cover material having a plaque Shore D hardness ranging from 40 to 50, and the on cover Shore D hardness less than 56;

wherein a dual core deflection differential of the inner core having a deflection of at least 0.230 inch under a load of 220 pounds and the core having a deflection of at least 0.800 inch under a load of 200 pounds allows for a low spin of a golf ball hit off a tee to provide greater distance, and a high spin of a golf ball hit on approach shots.

2. The golf ball according to claim 1 wherein the outer core is composed of a polybutadiene material, organic peroxide, zinc stearate, zinc diacrylate and zinc oxide.

3. The golf ball according to claim 1 wherein the inner mantle is composed of a fully neutralized polymer.

* * * * *